United States Patent [19]

Mastronardi et al.

[11] 3,957,322

[45] May 18, 1976

[54] CONTROL MEANS FOR SELECTIVELY SHIFTING STORAGE UNITS

[75] Inventors: Pasquale J. Mastronardi, Northfield; Gary M. Swart, Lincroft, both of N.J.

[73] Assignee: Estey Corporation, Red Bank, N.J.

[22] Filed: Mar. 6, 1975

[21] Appl. No.: 555,820

[52] U.S. Cl. ..... 312/198; 104/88; 312/201

[51] Int. Cl.[2] ..... A47B 53/02; B61B 13/12

[58] Field of Search ..... 312/198, 199, 200, 201, 312/147; 104/148 R, 188, 88, 235, 276, 172; 214/16 B, 6 T

[56] References Cited

UNITED STATES PATENTS

| | | | |
|---|---|---|---|
| 2,706,573 | 4/1955 | Ingold | 214/16 T |
| 3,535,009 | 2/1969 | Cain | 312/199 |
| 3,566,802 | 3/1971 | Lundquist | 104/172 |
| 3,665,864 | 5/1972 | Bildsoe | 104/88 |

*Primary Examiner*—Casmir A. Nunberg
*Attorney, Agent, or Firm*—Anthony J. Casella

[57] ABSTRACT

A series of storage units, such as bookcases, are mounted on a track with controlled power means for moving them to provide a single aisle between any two units. The other units are adjoining each other for conserving space and lighting means. The control means for each unit is mounted within the unit itself instead of coupled to an external master control. Any unit may be removed from the series without affecting the other units and a control circuit can be replaced without affecting the adjustment and operation of the other control circuits. The movement of the units is controlled so that the units move in sequential manner, spreading the motor current surges over a short time interval.

9 Claims, 12 Drawing Figures

SAFETY R
SAFETY L
AISLE
RESET
OFF
115 V.
24 V.

CONTROL MEANS FOR SELECTIVELY SHIFTING STORAGE UNITS

BACKGROUND OF THE INVENTION

The invention relates to storage systems including a plurality of storage units, each of which rolls on tracks and is powered for movement by an electric motor. A storage system of this type is disclosed in U.S. Patent Application Ser. No. 69,012 filed on Sept. 2, 1970. In the prior system, a central control circuit governed the movements of the separate units. In the present invention all the control circuitry for each unit is carried by the units themselves, thereby making each unit an independent modular element. Each unit may be removed or inserted into the stack assembly without changing or altering the other units. The circuitry in each unit is simplified and made more direct acting than prior circuit control means of this type. A single manually operated push button near an aisle is operated to move the units to open the aisle for human entry.

SUMMARY

The invention comprises a storage array of a plurality of mobile storage units, each unit having a separate motor for movement along a common track in either direction. The directional movement is controlled by relays which control the motors to open a space between units. A sensing unit is positioned on each side of each unit for sensing the presence of an adjoining unit. The sensing units each include an electric switch which is closed when the sensing unit is not operated and opens when an adjoining unit actuates it. A sensing relay winding is connected in series between the switch and a source of potential. A manually operated aisle switch is connected in series with an aisle relay and a source of potential, the relay winding controlling a pair of normally open contacts connected in series with the winding of one of the directional relays. Each directional relay includes two normally open contacts which are connected in series between a source of potential and the operating windings on the motors.

Each of the mobile storage units is connected to its adjacent unit by a cable containing five conductors. This connecting means provides for the sequential movement of units when more than one is required to move. Each storage unit is provided with at least two safety switches on each of its faces for stopping the unit motion when a person or other obstruction is in an aisle about to be closed. Additional features and means of operation of the invention will be disclosed in the following description, taken in connection with the accompanying drawings.

BRIEF DESCRIPTION OF THE DRAWINGS

FIGS. 7, 8 and 9 are connected together, the completed circuit is the circuit of a three unit array.

FIGS. 7, 8 and 9 are to be joined to form a complete circuit diagram for three storage units.

FIGS. 11 and 12 are used in conjunction with the explanation of the operation.

DESCRIPTION OF THE PREFERRED EMBODIMENT

Figure 1:
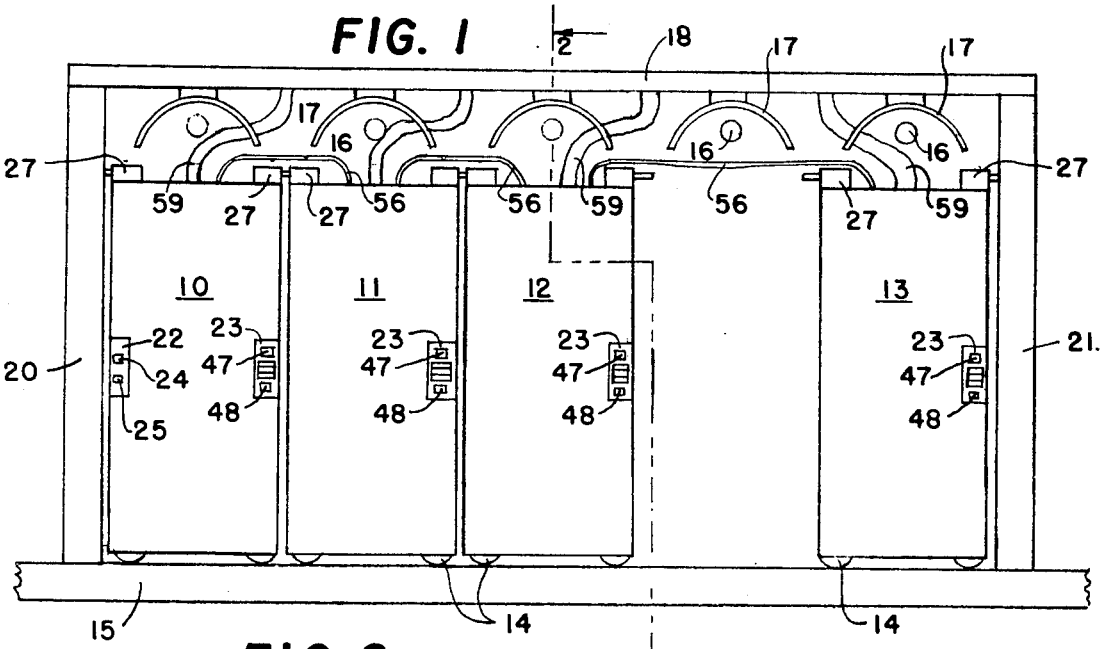
FIG. 1 is a side view of an array of four storage units mounted side by side on a pair of rails.

FIGS. 1, 2, 3 and 6 provide general views of the array of modular storage units and their operation. FIG. 1 shows four units 10, 11, 12, and 13, which may be bookcases or storage means for any other type of article. Each unit is mounted on wheels 14 which move on a track 15. Lamps 16 housed in reflectors 17 are mounted on a cross beam 18 and spaced so that each lamp is over an aisle when the units are opened under it. Vertical supporting columns 20, 21 hold the cross beam 18 and provide a limit for the movement of the units. In this system all four of the units are movable, permitting aisles to be formed at the extreme right or left of the units.

Figure 6:
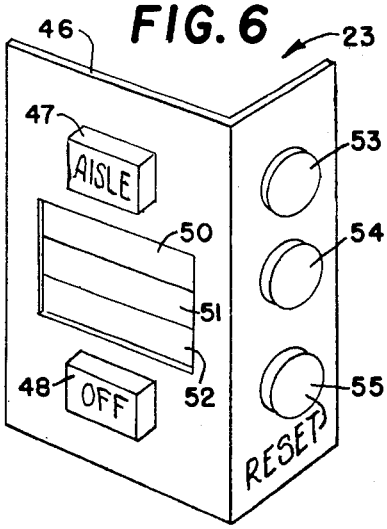
FIG. 6 is a perspective view of one of the switch boards secured to each storage unit. The switch board includes three indicating lamps, and five manually operable switches, one of which 48 is illuminated.

The left units 10 includes two switch boards 22 and 23, each mounted on a corner of the unit. The switch board 23 is the same for all units and its details are shown in FIG. 6 to be described later. Switch board 22 contains only two manually operated switches, one 24 is an aisle switch, the other is an OFF switch 25 designed to stop the movement of unit 10 while moving to the right.

The motor 26 which moves the storage unit is positioned near the floor in each unit and is coupled to the wheels 14 either directly or by a gear or chain reduction unit.

Figure 4:
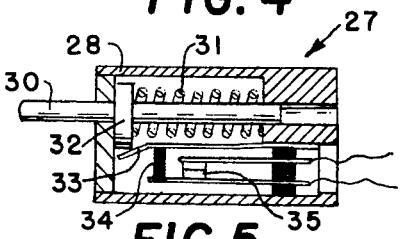
FIG. 4 is a cross sectional view of one form of sensing unit wherein a resiliently stressed sensing rod is shown with a pair of closed contacts.
Figure 5:
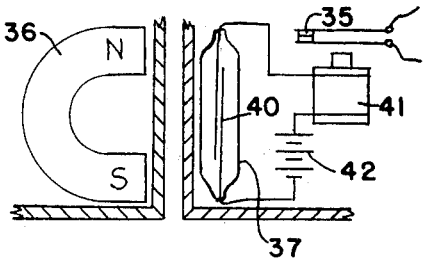
FIG. 5 is a partial cross sectional view of an alternate form of sensing means wherein a magnet in one unit controls the closing of a pair of contacts in an adjacent unit.

The main control components are the sensing means 27, shown in greater detail in FIGS. 4 and 5. Each sensing means includes a case 28, a sensing rod 30 urged to an extended position by a spring 31. A collar 32 limits the motion of the rod 30 with its edge engaging a flat spring 33. An insulator 34 connects the spring 33 with one side of a pair of contacts 35, connected in the control circuit. When there is no adjoining unit, the rod 30 remains in the position shown and contacts 35 are closed. When a unit is moved next to the sensing means 27, rod 30 is moved to the right, opening contacts 35.

FIG. 5 shows an alternate form of sensing means where a permanent magnet 36 is positioned adjacent to the base of one unit next to a sheet of non-magnetic material, such as aluminum. A reed switch including envelope 37 containing two normally separated iron wires 40 is mounted at the base of the next unit also adjoining a non-magnetic sheet. The wires 40 have external terminals which are connected to a relay winding 41 in series with a source of potential 42. Relay contacts 35 are normally closed but when the two units are brought close together, the magnetic lines of force from the magnet 36 cause wires 40 to make contact and send current through the relay winding, opening contacts 35.

Figure 3:
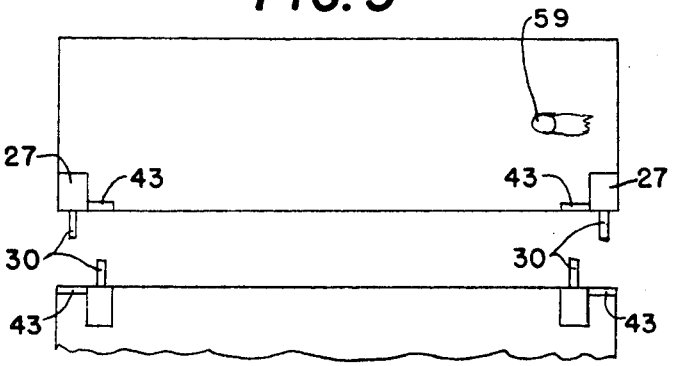
FIG. 3 is a top view of two of the units, separated from each other and showing the sensing units.

The rods 30 on adjacent units may be arranged to make contact with each other but experiment has shown that a more reliable arrangement is to provide a target 43 for each of the rods 30 as indicated in FIG. 3.

Each storage unit is provided with a waist high safety bar 44 and a base safety bar 45 for making contact with a foot of a person who may be caught between two storage units when one is moving to eliminate the aisle between them. Other objects, such as stools or books, left in the aisle will operate the bars. Operation of either of the safety bars 44 or 45 will stop the motion of the unit.

The switchboard 23 is shown in greater detail in FIG. 6. An angle bracket 46 is secured to the right hand edge of all units and houses an aisle switch button 47, an OFF button 48 and three glass windows 50, 51 and 52. Three lamps are positioned behind these windows and denote POWER ON, LOW VOLTAGE OVERLOAD, and MOTOR OVERLOAD. The lamps are connected to appropriate parts of the control circuit; these are not shown in the circuit diagram because their use is old and not a part of the invention. On the side section of the switchboard two reset buttons 53 and 54 are mechanically connected to circuit breakers in the low voltage supply and the high voltage conductors. The buttons are used to reset the breakers. A third reset switch button 55 is used to reset the control circuit after the safety bar has stopped the motion of the unit. The reset and OFF switches are shown in the control circuit diagram and their function will be described later. An additional switchboard 22 is secured to the left edge of the left unit 10. It contains only an aisle button 24 and a stop button 25.

UNIT CONTROL CIRCUIT

Figure 7:
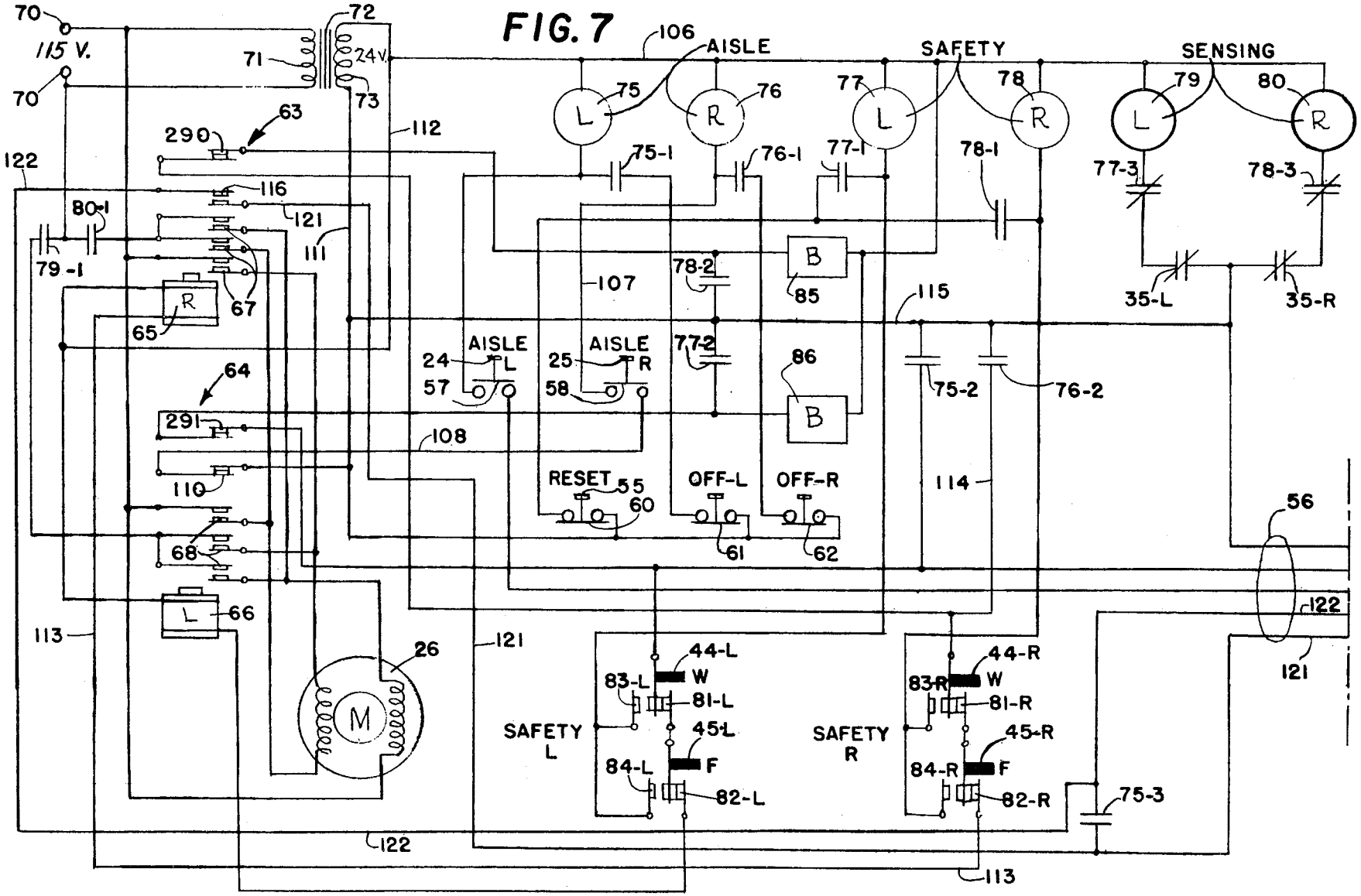
FIG. 7 is a circuit diagram of connections of the left end unit. This unit has two aisle buttons.
Figure 8:
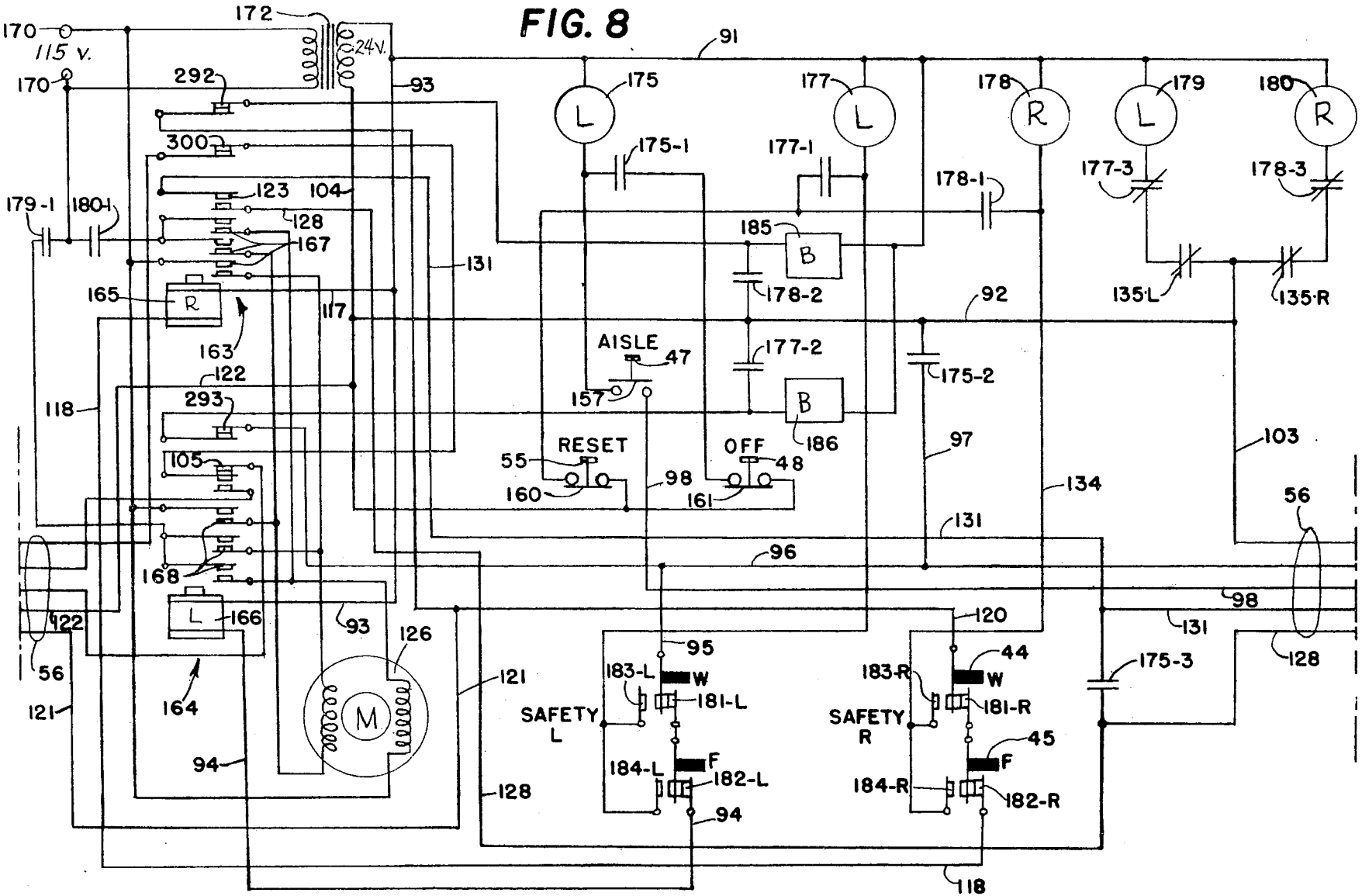
FIG. 8 is a circuit diagram of connections of the central unit or units. This unit has a single aisle button.
Figures 7, 8, 9, 10, 11, 12:
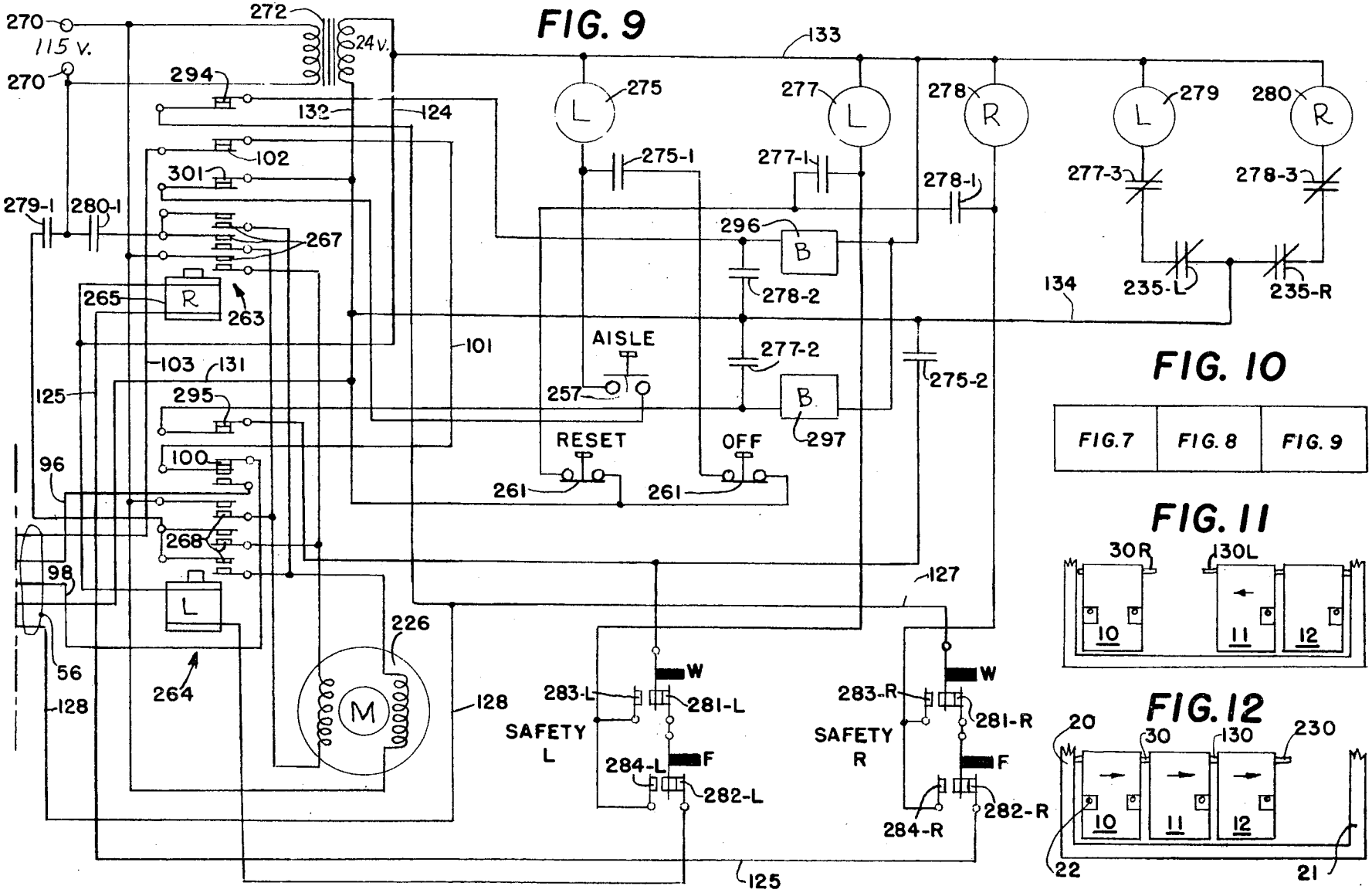
FIG. 9 is a circuit diagram of connections of the right end unit. This unit also has a single aisle button. When
FIG. 10 is a diagram showing how
FIG. 11 is a simplified diagram showing three storage units with a space between the first and second units.
FIG. 12 is a diagram similar to FIG. 11 showing all the storage units grouped on the left side.

The control circuit for three storage units is shown in FIGS. 7, 8, and 9. When these three circuits are combined as indicated in FIG. 10, the control circuit is complete. As indicated, there are five conductors connecting each unit with the adjacent unit. Connection may be made by plug sockets and cables 56. A power cable 59 is connected to all movable units (see FIG. 1) FIG. 7 includes two aisle switches 57 and 58, one reset switch 60, and two OFF switches 61 an 62. Aisle switch 58 and OFF switch 62 are located at the left edge of storage unit 10 on board 22 while switches 57, 60, and 61 are part of the right hand switchboard 23 on the same unit.

The circuit shown in FIG. 7 includes two directional motor relays, one of which 63 controls the motor 26 to turn so as to move the unit to the right; the other 64 controls the motor to move to the left. Each relay assembly includes a winding 65, 66 and three normally open contact pair 67, 68 which, when closed, send current of the desired polarity to the motor windings 26A and 26B to turn the motor in the proper direction. In addition, relays 63 and 64 contain two pairs of auxilliary contacts, each for controlling other parts of the circuit. The use of these contacts will be explained when the operation of the circuit is considered.

Power for operating the circuit is obtained from a 115 volt power line attached to terminal 70. The motor 26 is operated by current from this source.

Terminals 70 are connected to the primary winding 71 of a step down transformer 72, having a low voltage winding 73. The low voltage source is used to activate the relay windings and the other control components. The main control means include six relays; two aisle relays for control of the directional circuits, two safety relays coupled to the waist and foot bars, and two sensing relays coupled to the safety switches for controlling the motors. The left aisle relay includes a winding 75 and three contacts; a locking contact 75-1, a motor contact 75-2, and a transfer contact 75-3 designed to actuate a motor relay in the adjoining storage unit. The right aisle relay includes a winding 76 and two contacts; a locking contact 76-1, and a buzzer contact 76-2.

The left safety relay include a winding 77 and three contact assemblies; a locking contact 77-1, a second buzzer contact 77-2, and a normally closed pair of contacts 77-3 in series with the left sensing relay. The right safety relay includes a winding 78 and three contact assemblies; a locking pair 78-1, a buzzer contact 78-2, and a normally closed pair of contacts 78-3. The left sensing relay includes a winding 79 connected in series between the power source and the sensing contacts 35-L. This relay includes only one pair of contacts 79-1 connected to one terminal of the high voltage source. The right sensing relay includes a winding 80 similar to winding 79 and a single pair of contact 80-1 also connected to the same terminal of the voltage source.

Figure 2:
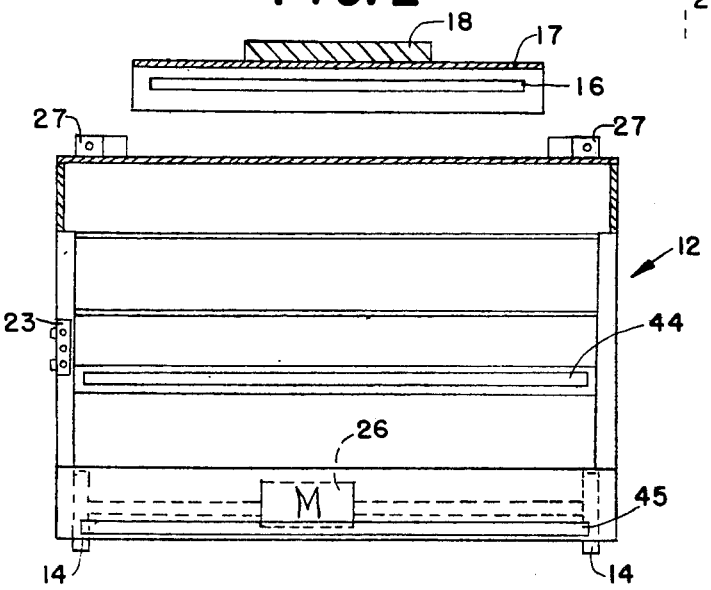
FIG. 2 is a cross sectional view of the array shown in FIG. 1 and is taken along line 2—2 of FIG. 1.

The waist and foot safety bars 44 and 45, shown in FIG. 2, are each coupled to a pair of normally closed contacts 81, 82 (FIG. 7) and to a pair of normally open contacts 83, 84. The control circuit of FIG. 7 also includes two warning buzzers 85 and 86. The auxilliary contacts on each of the motor relays 63, 64 will be described when the operation of the circuit is explained.

The control circuit shown in FIG. 8 is for all intermediate units and is similar to the circuit shown in FIG. 7 except that there is only one aisle switch 157 one OFF switch 161, and only one aisle relay with a winding 175 and three contact assemblies 175-1, 175-2 and 175-3. The other components of this circuit will be described when the operation is discussed. If there are more than three storage units in the group, the additional units will have a control circuit the same as FIG. 8 with input and output cables 56 joined to adjacent cables as indicated.

The control circuit shown in FIG. 9 is the circuit installed in the right end storage unit and is similar to the circuit shown in FIG. 8 except that there is no cable connection 56 to a right hand unit and only two contacts on the aisle relay, there being no contacts corresponding to contacts 75-3 of FIG. 7.

OPERATION

In order to explain the operation of the invention, two arrangements of storage units will be considered. First, let it be assumed that the three units are positioned as shown in FIG. 11 with an aisle opening between the first and second units 10 and 11. In this position the right sensing rod 30R of unit 10 and the left sensing rod 130L of unit 11 are extended and their associated contacts 35R (FIG. 7) and 135L (FIG. 8) are closed. All other sensing rods are pushed into their retracted positions and their associated contacts are open.

An operator may now depress the aisle button 47 to close switch 157 (FIG. 8) to open an aisle space between unit 11 and 12. This action completes several circuits one of which may be traced from the top terminal of transformer 172, over conductor 91, through relay winding 179 and contacts 135L (contacts 135R are open), and back over conductor 92 to the other side of the transformer. Activation of relay winding 179 closes contacts 179-1 and applies 115 volts to all the contacts 168 on relay 164. A second circuit may be traced from the top terminal of transformer 172 over conductor 93, through winding 166 of motor relay 164, then over conductor 94, through safety switches 182-L and 181-L, over conductors 95, 96, and 97, through now closed contacts 175-2 of relay 175, and back to the other side of the transformer 172. This circuit closes contacts 168 on motor relay 164 and starts motor 126 to move the storage unit 11 to the left. A third circuit can be traced from conductor 91 through relay winding 175 and aisle switch 157, then over conductor 98 and through cable 56 to the control circuit in unit 12. In unit 12 (FIG. 9) the circuit continues over conductor 98, through auxilliary motor contacts 100, conductor 101, contacts 102, and back through cable 56 over conductor 103. In unit 11 (FIG. 8) the circuit continues over conductors 103, 92, and 104, to the other transformer terminal. This last described circuit starts the motor 126 only if relays 264 and 263 are in their unactuated condition. Motor 126 continues to run, moving storage unit 11 to the left until sensing rod 130-L comes in contact with unit 10. This action opens sensing contacts 135-L, normalizes relay winding 179, and opens contacts 179-1, cutting current from the motor 126 and stopping the unit movement. At this time the aisle relay 175 is still in its locked condition and the OFF button 48 must be depressed to break the locking circuit. At this time all circuits in unit 12 (FIG. 9) are normalized except contacts 235-R which are open.

While the aisle relay 175 is in its locked condition the other aisle circuits cannot product any motor activation. This is because the motor relay 164 is still activated and contacts 105 are open, preventing current from flowing through winding 66 (FIG. 7) and starting motor 26.

Let it now be assumed that all three storage units 10, 11 and 12 are on the left, as shown in FIG. 12. In this position rod 230 is extended and contacts 235-R are closed. An operator wishes to enter the first aisle space between the wall 20 and unit 10. The operator depresses the left button 24 on unit 10 and unit 12 starts to move to the right. As soon as rod 130 on unit 11 is extended, unit 11 also moves to the right, followed by unit 10 when its rod 30 is extended. The three storage units continue their motion until rod 230 strikes wall 21 and rod 230 is depressed. Units 11 and 10 follow in quick succession with their sensing rods being depressed in sequential order. As each rod is depressed, the motor in that unit is stopped because, as contacts 235-R, 135-R, and 35-R are opened current is cut off from relay windings 280, 180, and 80, and contacts 280-1, 180-1, and 80-1 are opened cutting off current to motors 226, 126, and 26 respectively.

A more detailed description of this operation is as follows: When aisle switch 58 (FIG. 7) is depressed a first circuit is completed which can be traced from the top terminal of transformer 72 over conductor 106, relay winding 76, conductor 107, through aisle switch 58, conductor 108, closed contacts 110, and then back to transformer 72 by means of conductor 111. This current causes the actuation of relay 76 and contacts 76-1 and 76-2 are closed. Contacts 76-1 are locking contacts and complete a locking circuit through contacts 76-1 and OFF-R switch 62. Contact 76-2 complete a circuit which may be traced from the top terminal of transformer 72, over conductor 112, through winding 65, operating the relay, then over conductor 113, through safety contacts 82-R and 81-R, over conductor 114, through contacts 76-2, and back to the lower transformer terminal by way of conductors 115 and 111. Relay 63 remains in its actuated condition but motor 26 does not turn at this time because contacts 80-1 are open.

When relay 63 is actuated, contacts 116 are closed, completing a circuit which may be traced from the upper terminal of transformer 172 (FIG. 8), over conductors 93 and 117, through relay winding 165, over conductor 118, then through safety contacts 182-R and 181-R, over conductors 120 and 121, through contacts 116, (FIG. 7) then over conductors 122 and 104 (FIG. 8) to the other side of transformer 172. This circuit actuates relay 163 closing motor contacts 167 but, like motor 26, motor 126 does not turn because contacts 180-1 are open.

When relay 163 is actuated, contacts 123 are closed, completing a circuit which may be traced from the upper terminal of transformer 272 (FIG. 9) over conductors 124, through winding 265 of relay 263, then over conductor 125, through contacts 282-R and 281-R, over conductors 127 and 128 to contacts 123 (FIG. 8) which are now closed. From this circuit continues over conductors 131 and 132 to the other side of transformer 272 (FIG. 9). As shown in FIG. 12, rod 230 is in its extended position, closing contacts 235-R and sending current from the transformer 272, over conductor 133, through relay winding 280, closed contacts 278-3 and 235-R, back to the other side of the transformer by way of conductors 134 and 132. Activation of relay winding 280 closes contacts 280-1 and sends operating current from high voltage terminals 270 through contacts 280-1, through now closed motor contacts 267 to both motor windings in motor 226 turning the motor to move storage unit 12 to the right.

As unit 12 moves to the right (FIG. 12) the sensing rod 130 on the right side of unit 11 is extended, closing contacts 135-R controlled by this rod (FIG. 8) and current then flows through winding 180, closing contacts 180-1 and sending high voltage current through the three contacts 167 to energize motor 126 and run it to move the storage unit 11 to the right, following unit 12. As unit 11 moves to the right, the sensing rod 30 (FIG. 7) is extended and contacts 35-R are closed, sending current through relay winding 80 and closing contacts 80-1. This action sends high voltage current through three contacts 67 and turns motor 26 to move storage unit 10 to the right following units 11 and 12.

When storage unit 12 reaches supporting column 21, rod 230 is depressed, normalizing relay 280 and opening contacts 280-1, thereby cutting off the current from motor 226 and stopping the movement of unit 12. In a similar manner, as units 11 and 10 approach the end of their travel, rods 130 and 30 are successively depressed, normalizing relays 180 and 80 and opening contacts 180-1 and 80-1, thereby stopping motors 126 and 26 and their storage units.

The operation of the safety circuits and their contacts is clear from the circuit diagrams. In FIG. 8, if unit 11 is, for any reason, made to approach unit 12 with a person between these units, the movement of the waist bar 44 or the foot bar 45 opens contacts 181-R or contacts 182-R and closes contacts 183-R or 184-R. The opening of contacts 181-R cuts off the current to relay winding 165, opens contacts 167 and stops motor 126. The closing of contacts 183-R and 184-R sends current from conductor 120, over conductor 134 and relay winding 178, activating the relay and closing contacts 178-1 and 178-2. Contacts 178-1 are locking contacts while contacts 178-2 connect the warning buzzer 185 to the transformer to provide a warning signal. This circuit is normalized only by depressing the reset switch 160 which opens the locking circuit.

The above operating procedures have been applied to a three storage unit array. If more units are added they will be positioned between units 10 and 12 and have a control circuit the same as unit 11, as illustrated in FIG. 8. As mentioned above, additional units can be added by providing separable plug and socket connectors to cables 56. The result is an automatic array of storage units which can be used to save considerable storage space and be operated by push buttons.

All the motor relays 63, 64, 163, 164, etc. are provided with auxilliary contact pairs which either activate buzzers or open circuit to prevent movement of storage units in the wrong direction. In FIG. 7, contacts 290 are connected in series with the low voltage source 73, buzzer 85, and normally open contacts 76-2. Whenever the aisle relay 76 is operated (closing contacts 76-2) and the motor relay 63 fails to operate for any reason, the buzzer circuit is completed and the operator is warned of the misfunction. Contacts 291 on motor relay 64 act in a similar manner, completing a circuit which includes buzzer 86, contacts 291 and contacts 75-2. Auxilliary contacts 116 and 110 have been described above in connection with the operation of moving all three units 10, 11, and 12 to the right. Contacts 116 are in series with the safety contacts 181-R and 182-R in unit 11 (FIG. 8). Contacts 110 are in series with the actuating circuit which operates the relay 76, preventing such operation when the left motor relay 64 is in its operated condition.

In a similar manner, auxilliary contacts 292 in FIG. 8 are in series with buzzer 185, the low voltage source 172, conductors 104, 122, contacts 116 on motor relay 63, and back over conductor 121 to the other side of the contacts 292. This pair of auxilliary contacts sounds buzzer 185 whenever motor relay 63 is actuated and motor relay 163 is unactuated. Buzzer 186 is connected in series with the source of low voltage 172, contacts 293, and contacts 175-2. The warning buzzer is sounded whenever the aisle switch 157 is closed and motor relay 163 fails to be actuated. Auxilliary contacts 294 and 295 (FIG. 9) act in a similar manner to actuate buzzers 296 and 297 when a motor relay malfunctions.

Auxilliary contacts 300 on motor relay 163 (FIG. 8) are connected in series with upper contacts 105 on motor relay 164 and insure that the aisle switch 57 in unit 10 (FIG. 7) cannot function whenever either relay 163 or 164 is actuated. In a similar manner auxilliary contacts 301 (FIG. 9) on motor relay 263 are connected in series with aisle switch 257 to prevent actuation of relay winding 275 when relay 263 is in its actuated condition.

The safety and interlocking circuits and contacts described above are necessary because, in a public library where the units are used as book cases, several operators are liable to try to open different aisles at the same time. The above described circuits provide safeguards against such faulty operation.

What is claimed is:

1. In a storage array including a plurality of mobile storage units, each unit having a separate motor for movement along a common track in either direction controlled by right and left directional motor relays to open a desired aisle space between units; the improvement comprising:

a. a sensing means on each side of each unit for sensing the presence of an adjoining unit, said sensing means each including an electric sensing switch which is closed when the sensing means is unactuated and a sensing relay winding connected in series between the switch and a source of potential;

b. a manually operable aisle switch connected in series with an aisle relay and a source of potential, said relay winding controlling a pair of normally open contacts connected in series with the winding of one of said directional relays;

c. said directional relays including three normally open contacts, which are connected in series between a source of potential and operating windings on said motors; and d. a control circuit in each storage unit comprising a series circuit which includes; a source of electric power, the winding of a directional motor relay, and a pair of normally closed auxilliary contacts on a directional motor relay in an adjacent storage unit; said series circuit being provided for preventing the actuation of the directional motor relay when the adjacent motor relay is actuated and said normally closed contacts are opened.

2. A storage array according to claim 1 wherein said sensing means is a resiliently stressed movable rod extending beyond the storage unit.

3. A storage array according to claim 1 wherein said sensing means is the combination of a source of magnetic lines of force and a magnetic sensing element.

4. A storage array according to claim 3 wherein said magnetic sensing element is an electric switch having a pair of normally separated ferromagnetic terminals.

5. A storage array according to claim 1 wherein each control circuit includes multiple closed contacts in a personnel safety device, said multiple closed contacts connected in series with the winding of said directional motor relay.

6. A storage array according to claim 5 wherein safety devices are operable by contact with an object adjoining a storage unit moving to close an aisle.

7. A storage array according to claim 5 wherein said multiple closed contacts are each a single pole double throw switch and include normally open contacts which close when the contacts are actuated and send current to the winding of a safety relay and close relay contacts to operate an alarm.

8. A storage array according to claim 1 wherein each aisle switch is connected to a winding of an aisle relay, said winding locking contacts connected in series with a locking circuit for sending current through the winding after the manually operable switch is opened.

9. A storage array according to claim 8 wherein said locking circuit includes an OFF switch when manually operated breaks the current through the locking circuit and normalizes the relay.

* * * * *